US009840930B2

(12) United States Patent
Lee et al.

(10) Patent No.: US 9,840,930 B2
(45) Date of Patent: Dec. 12, 2017

(54) INTERNAL COOLING SYSTEM WITH INSERT FORMING NEARWALL COOLING CHANNELS IN MIDCHORD COOLING CAVITIES OF A GAS TURBINE AIRFOIL

(71) Applicant: Siemens Aktiengesellschaft, München (DE)

(72) Inventors: Ching-Pang Lee, Cincinnati, OH (US); Jae Y. Um, Winter Garden, FL (US); Gerald L. Hillier, Charlottesville, VA (US); Wayne J. McDonald, Charlotte, NC (US); Mohamed Abdullah, Cincinnati, OH (US); Eric Schroeder, Loveland, OH (US); Ralph W. Matthews, Oviedo, FL (US); Zhengxiang Pu, Oviedo, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 15/505,170

(22) PCT Filed: Sep. 4, 2014

(86) PCT No.: PCT/US2014/053978
§ 371 (c)(1),
(2) Date: Feb. 20, 2017

(87) PCT Pub. No.: WO2016/036367
PCT Pub. Date: Mar. 10, 2016

(65) Prior Publication Data
US 2017/0268358 A1 Sep. 21, 2017

(51) Int. Cl.
*F01D 5/18* (2006.01)
*F01D 9/06* (2006.01)

(52) U.S. Cl.
CPC ..... *F01D 9/065* (2013.01); *F01D 5/186* (2013.01); *F01D 5/187* (2013.01); *F01D 5/188* (2013.01);
(Continued)

(58) Field of Classification Search
CPC ..... F01D 5/187; F01D 5/188; F01D 5/189; F01D 5/186; F05D 2220/32;
(Continued)

(56) References Cited

U.S. PATENT DOCUMENTS 3,846,041 A 11/1974 Albani
3,973,874 A 8/1976 Corsmeier et al.
(Continued)

FOREIGN PATENT DOCUMENTS

EP 0541207 A1 11/1991
EP 1091091 A2 4/2001
(Continued)

OTHER PUBLICATIONS

PCT International Search Report and Written Opinion dated May 18, 2015 corresponding to PCT Application PCT/US2014/053978 filed Sep. 4, 2014.

*Primary Examiner* — Igor Kershteyn

(57) ABSTRACT

An airfoil (10) for a gas turbine engine in which the airfoil (10) includes an internal cooling system (14) with one or more internal cavities (16) having an insert (18) contained therein that forms nearwall cooling channels (20) having enhanced flow patterns is disclosed. The flow of cooling fluids in the nearwall cooling channels (20) may be controlled via a plurality of cooling fluid flow controllers (22) extending from the outer wall (24) forming the generally hollow elongated airfoil (26). The cooling fluid flow controllers (22) may be collected into spanwise extending rows (28), and the internal cooling system (14) may include one
(Continued)

or more bypass flow reducers (30) extending from the insert (18) toward the outer wall (24) to direct the cooling fluids through the channels (20) created by the cooling fluid flow controllers (22), thereby increasing the effectiveness of the internal cooling system (14).

14 Claims, 6 Drawing Sheets

(52) U.S. Cl.
CPC ..... *F01D 5/189* (2013.01); *F05D 2220/32* (2013.01); *F05D 2250/183* (2013.01); *F05D 2260/20* (2013.01); *F05D 2260/201* (2013.01); *F05D 2260/202* (2013.01)

(58) Field of Classification Search
CPC ..... F05D 2250/183; F05D 2260/20; F05D 2260/201; F05D 2260/202
See application file for complete search history.

(56) References Cited

U.S. PATENT DOCUMENTS

| | | | | |
|---|---|---|---|---|
| 4,257,734 | A | 3/1981 | Guy et al. | |
| 4,403,917 | A | 9/1983 | Laffitte et al. | |
| 5,027,604 | A | 7/1991 | Krueger | |
| 5,246,341 | A * | 9/1993 | Hall | F01D 5/187 416/97 R |
| 5,253,976 | A | 10/1993 | Cunha | |
| 5,533,864 | A | 7/1996 | Nomoto et al. | |
| 5,591,002 | A | 1/1997 | Cunha et al. | |
| 5,624,231 | A | 4/1997 | Ohtomo et al. | |
| 5,690,472 | A * | 11/1997 | Lee | F01D 5/187 416/95 |
| 5,704,763 | A * | 1/1998 | Lee | F01D 5/188 415/115 |
| 6,036,436 | A | 3/2000 | Fukuno et al. | |
| 6,183,194 | B1 | 2/2001 | Cunha et al. | |
| 6,439,846 | B1 | 8/2002 | Anderson et al. | |
| 7,753,650 | B1 * | 7/2010 | Liang | F01D 5/187 416/97 R |
| 8,052,378 | B2 * | 11/2011 | Draper | F01D 5/186 415/115 |
| 8,172,504 | B2 | 5/2012 | Flodman et al. | |
| 8,197,210 | B1 | 6/2012 | Liang | |
| 8,322,988 | B1 | 12/2012 | Downs et al. | |
| 8,348,613 | B2 | 1/2013 | Gregg et al. | |
| 8,403,631 | B2 | 3/2013 | Surace et al. | |
| 8,500,405 | B1 | 8/2013 | Jones et al. | |
| 2007/0110585 | A1 | 5/2007 | Bonnet | |
| 2010/0054915 | A1 | 3/2010 | Devore et al. | |
| 2010/0247284 | A1 * | 9/2010 | Gregg | F01D 5/189 415/1 |
| 2011/0107769 | A1 | 5/2011 | Stevenson et al. | |
| 2011/0123351 | A1 | 5/2011 | Hada et al. | |
| 2014/0110559 | A1 | 4/2014 | Lee et al. | |
| 2014/0112799 | A1 | 4/2014 | Lee et al. | |
| 2015/0159489 | A1 * | 6/2015 | Lee | F01D 5/187 416/97 R |
| 2015/0198050 | A1 * | 7/2015 | Lee | F01D 5/188 415/115 |

FOREIGN PATENT DOCUMENTS

| | | | |
|---|---|---|---|
| EP | 1188902 | A2 | 3/2002 |
| EP | 1221538 | A2 | 10/2002 |
| EP | 2107214 | A1 | 10/2009 |
| EP | 2233693 | A1 | 9/2010 |
| GB | 1508571 | A | 4/1978 |
| JP | S61187501 | A | 8/1986 |
| JP | S6380004 | A | 4/1988 |

* cited by examiner

INTERNAL COOLING SYSTEM WITH INSERT FORMING NEARWALL COOLING CHANNELS IN MIDCHORD COOLING CAVITIES OF A GAS TURBINE AIRFOIL

FIELD OF THE INVENTION

This invention is directed generally to gas turbine engines, and more particularly to internal cooling systems for airfoils in gas turbine engines.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to high temperatures. As a result, turbine vanes and blades must be made of materials capable of withstanding such high temperatures, or must include cooling features to enable the component to survive in an environment which exceeds the capability of the material. Turbine engines typically include a plurality of rows of stationary turbine vanes extending radially inward from a shell and include a plurality of rows of rotatable turbine blades attached to a rotor assembly for turning the rotor.

Typically, the turbine vanes are exposed to high temperature combustor gases that heat the airfoil. The airfoils include internal cooling systems for reducing the temperature of the airfoils. Airfoils have had internal inserts forming nearwall cooling channels. However, most inserts are formed from plain sheet metal with a plurality of impingement holes therein to provide impingement cooling on the pressure and suction sides of the airfoil. The upstream post impingement air pass downstream impingement jets and forms cross flow before exiting through film holes. The cross flow can bend the impinging jets away from the impingement target surface and reduce the cooling effectiveness. To reduce the amount of cross flow, the post impingement air has been vented out through exterior film holes. However, the greater the number of film cooling holes, the less efficient the usage of cooling air is. The impingement holes consume cooling air pressure and often pose a problem at the leading edge, where showerhead holes experience high stagnation gas pressure on the external surface. Thus, a need for a more efficient internal cooling system for gas turbine airfoils.

SUMMARY OF THE INVENTION

An airfoil for a gas turbine engine in which the airfoil includes an internal cooling system with one or more internal cavities having an insert contained therein that forms nearwall cooling channels having enhanced flow patterns is disclosed. The flow of cooling fluids in the nearwall cooling channels may be controlled via a plurality of cooling fluid flow controllers extending from the outer wall forming the generally hollow elongated airfoil. The cooling fluid flow controllers may be collected into spanwise extending rows, and the internal cooling system may include one or more bypass flow reducers extending from the insert toward the outer wall to direct the cooling fluids through the channels created by the cooling fluid flow controllers, thereby increasing the effectiveness of the internal cooling system.

In at least one embodiment, the turbine airfoil for a gas turbine engine may be formed from a generally elongated hollow airfoil formed from an outer wall, and having a leading edge, a trailing edge, a pressure side, a suction side, and inner endwall at a first end and an outer endwall at a second end that is generally on an opposite side of the generally elongated hollow airfoil from the first end and a cooling system positioned within interior aspects of the generally elongated hollow airfoil. The cooling system may include one or more midchord cooling cavities in which an insert is positioned that forms a pressure side nearwall cooling channel and a suction side nearwall cooling channel. A plurality of cooling fluid flow controllers may extend from the outer wall forming the generally elongated hollow airfoil toward the insert, where the cooling fluid flow controllers form a plurality of alternating zigzag channels extending downstream toward the trailing edge. One or more bypass flow reducers may extend from the insert toward the outer wall to reduce flow of cooling fluids.

One or more of the cooling fluid flow controllers may have a cross-sectional area formed by a pressure side that is on an opposite side from a suction side. The pressure and suction sides may be coupled together via a leading edge and trailing edge on an opposite end of the cooling fluid flow controller from the leading edge. A first spanwise extending row of cooling fluid flow controllers may include a plurality of cooling fluid flow controllers having a cross-sectional areas formed by a pressure side that is on an opposite side from a suction side, whereby the pressure and suction sides are coupled together via a leading edge and trailing edge on an opposite end of the at least one cooling fluid flow controller from the leading edge. A pressure side of one cooling fluid flow controller may be adjacent to a suction side of an adjacent cooling fluid flow controller. In another embodiment, each of the cooling fluid flow controllers within the first spanwise extending row of cooling fluid flow controllers may be positioned similarly, such that a pressure side of one cooling fluid flow controller is adjacent to a suction side of an adjacent cooling fluid flow controller, except for a cooling fluid flow controller at an end of the first spanwise extending row. The internal cooling system may include a second spanwise extending row of cooling fluid flow controllers positioned downstream from the first spanwise extending row of cooling fluid flow controllers. The second spanwise extending row of cooling fluid flow controllers may have one or more cooling fluid flow controllers with a pressure side on an opposite side of the cooling fluid flow controller than in the first spanwise extending row of cooling fluid flow controllers, thereby causing cooling fluid flowing through the second spanwise extending row of cooling fluid flow controllers to be directed downstream with a spanwise vector that is opposite to a spanwise vector imparted on the cooling fluid by the first spanwise extending row of cooling fluid flow controllers. As such, a zigzag flow channel is created.

In at least one embodiment, the midchord cooling cavity may include one or more ribs separating the midchord cooling cavity into a leading edge cooling cavity and a trailing edge cooling cavity. One or more impingement standoffs may extend from the outer wall forming the suction side radially inward toward the insert. The plurality of cooling fluid flow controllers may extend from the outer wall forming the pressure side of the generally elongated hollow airfoil. The insert may include a plurality of impingement holes directed toward the suction side of the generally elongated hollow airfoil. In at least one embodiment, the bypass flow reducer may be formed from a plurality of bypass flow reducers. One or more of the plurality of bypass flow reducers may be positioned between adjacent spanwise extending rows of cooling fluid flow controllers.

One or more forward support ribs may extend from an upstream end of the insert into contact with an upstream insert support, and an aft support rib extending from a downstream end of the insert into contact with a downstream insert support. The forward support rib extending from the upstream end of the insert may make contact with a pressure side of the upstream insert support, and the aft support rib extending from the downstream end of the insert may make contact with a pressure side of the downstream insert support.

During use, cooling fluids may be supplied from a compressor or other such source to the inner chamber of the insert of the internal cooling system. Cooling fluids may fill the insert and generally flow spanwise throughout the insert. Cooling fluids are passed through the cooling fluid exhaust outlet into the nearwall cooling channel on the pressure side and through the impingement holes into the nearwall cooling channel near the suction side. The cooling fluids in the nearwall cooling channel on the pressure side are prevented from flowing into the nearwall cooling channel on the suction side via the inset and the forward support rib and the aft support rib. The cooling fluids flowing from the impingement holes into the nearwall cooling channel near the suction side impinge upon the inner surface of the outer wall forming the suction side.

The cooling fluids in the nearwall cooling channel on the pressure side are directed toward an inner surface of the outer wall forming the pressure side by a first bypass flow reducer where the cooling fluids flow through a first row of cooling fluid flow controllers rather than flowing in between the small gap between a proximal end of the cooling fluid flow controllers and the insert. The bypass flow reducers direct the cooling fluids towards the outer wall forming the pressure side, thereby substantially reducing the flow of cooling fluids between the gap created between the proximal end of the cooling fluid flow controllers and the insert. In addition, the bypass flow reducers direct the cooling fluids towards the outer wall forming the pressure side, which directs the cooling fluids towards the outer wall, which is most need of cooling due to its direct exposure to the combustor exhaust gases. The cooling fluids flow through successive rows of cooling fluid flow controllers zigzagging back and forth and increasing in temperature moving toward the trailing edge as the cooling fluids pick up heat from the outer wall and the cooling fluid flow controllers. The cooling fluids may also flow past one or more rows of pin fins and may be exhausted from the film cooling holes. The cooling fluids may also form film cooling on an outer surface of the outer wall via the film cooling holes at the leading edge that are configured to form a showerhead and the other film cooling holes in the outer walls forming the pressure and suction sides.

An advantage of the internal cooling system is that the insert having the bypass flow reducers directs cooling fluids towards the outer wall to increase cooling rather than using a higher number of impingement holes in the insert, which would only increase the problems associated with cross flow.

Another advantage of the invention is that the unique pressure distribution expands the insert outwardly and pushes the whole insert against the forward support rib and the aft support rib.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
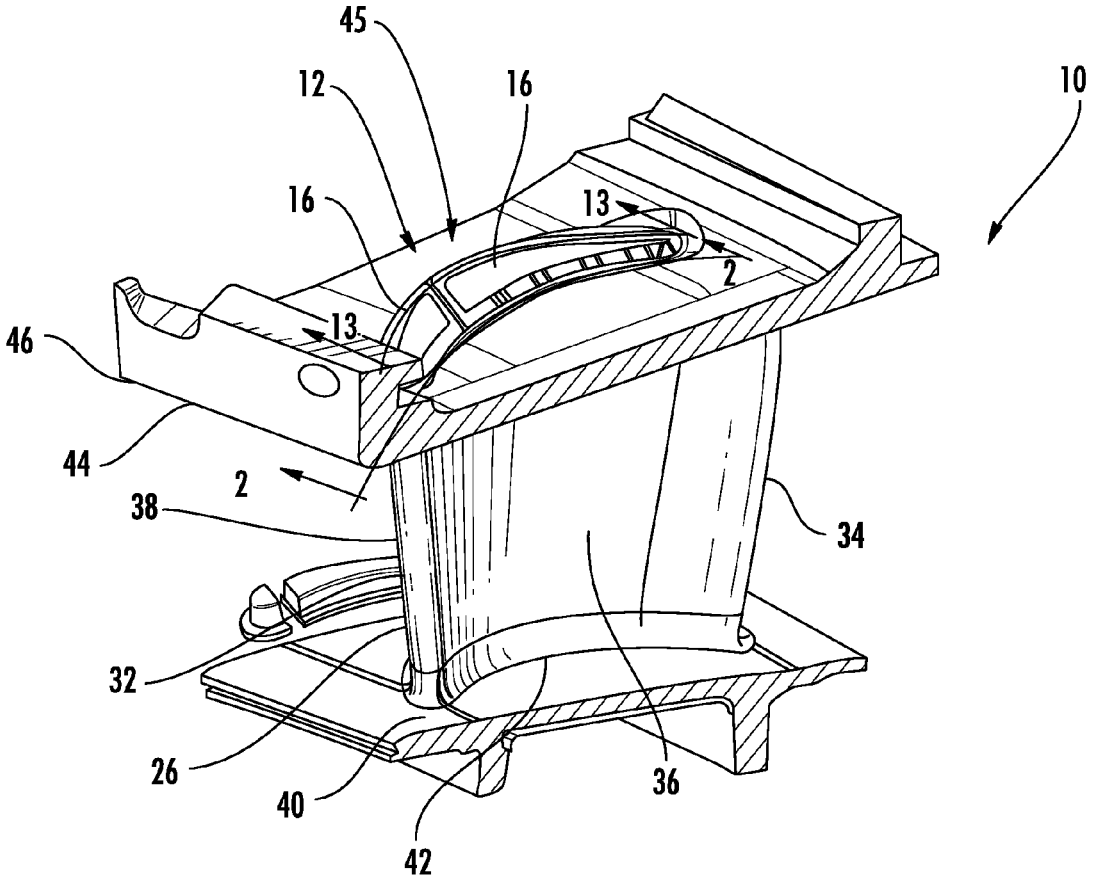
FIG. 1 is a perspective view of a turbine vane including the internal cooling system.
Figure 2:
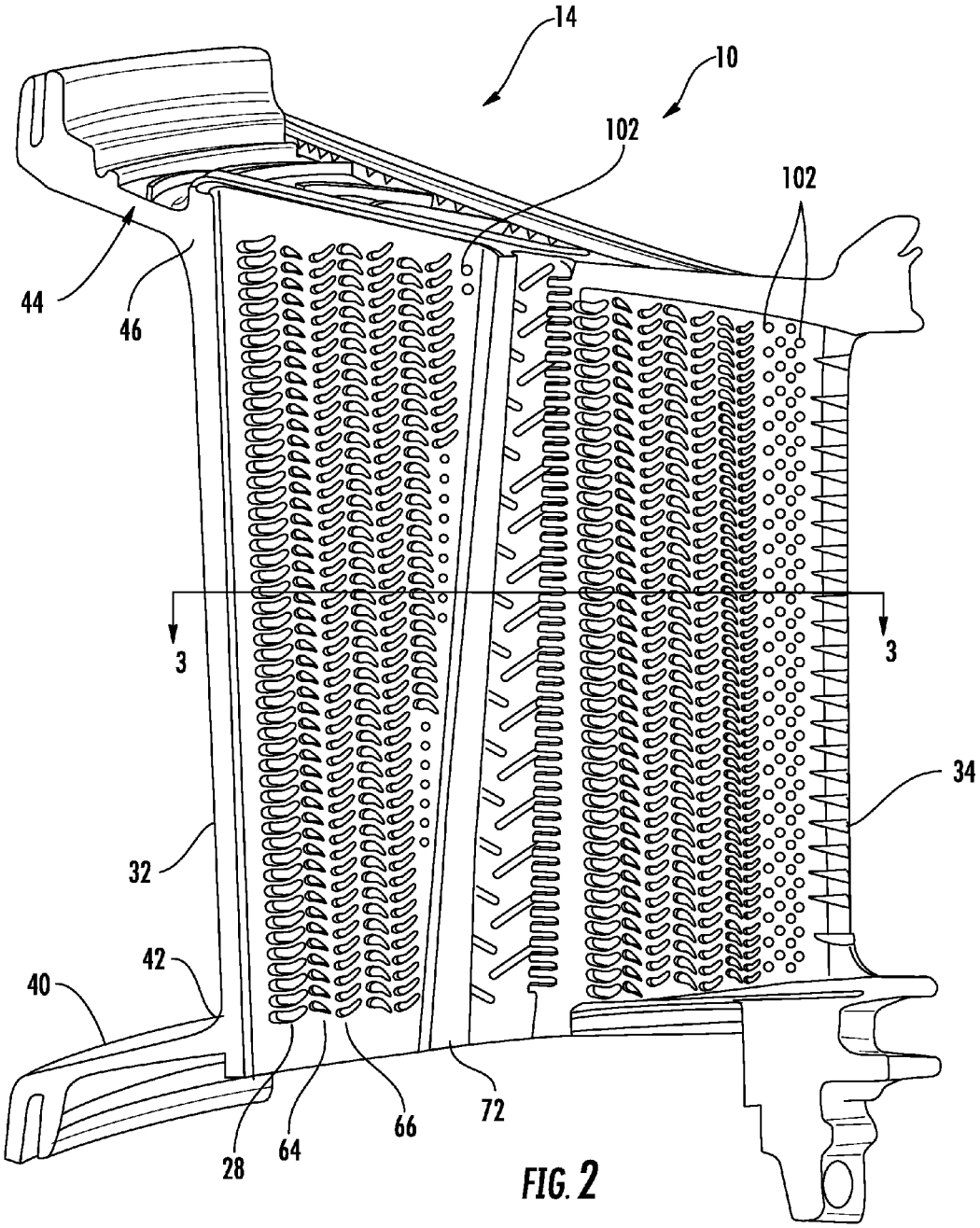
FIG. 2 is a cross-section view of the turbine vane taken at section line 2-2 in FIG. 1 of the internal cooling system, including the leading edge and trailing edge cooling cavities.

As shown in FIGS. 1-17, an airfoil 10 for a gas turbine engine in which the airfoil 10 includes an internal cooling system 14 with one or more internal cavities 16 having an insert 18 contained therein that forms nearwall cooling channels 20 having enhanced flow patterns is disclosed. The flow of cooling fluids in the nearwall cooling channels 20 may be controlled via a plurality of cooling fluid flow controllers 22 extending from the outer wall 24 forming the generally hollow elongated airfoil 26. The cooling fluid flow controllers 22 may be collected into spanwise extending rows 28, and the internal cooling system 14 may include one or more bypass flow reducers 30 extending from the insert 18 toward the outer wall 24 to direct the cooling fluids through the channels 20 created by the cooling fluid flow controllers 22, thereby increasing the effectiveness of the internal cooling system 14.

In at least one embodiment, as shown in FIG. 1, the airfoil 10 may be a turbine airfoil 10 for a gas turbine engine and may include a generally elongated hollow airfoil 26 formed from an outer wall 24, and having a leading edge 32, a trailing edge 34, a pressure side 36, a suction side 38, and inner endwall 40 at a first end 42 and an outer endwall 44 at a second end 46 that is generally on an opposite side of the generally elongated hollow airfoil 26 from the first end 42 and a cooling system 14 positioned within interior aspects of the generally elongated hollow airfoil 26. As shown in FIGS. 1, 3, 5, and 17, the cooling system 14 may include one or more midchord cooling cavities 45 in which an insert 18 is positioned that forms a pressure side nearwall cooling channel 48 and a suction side nearwall cooling channel 50. A plurality of cooling fluid flow controllers 22, as shown in FIGS. 2, 4 and 8-10, may extend from the outer wall 24 forming the generally elongated hollow airfoil 26 toward the insert 18. The cooling fluid flow controllers 22 may form a plurality of alternating zigzag channels 52 extending downstream toward the trailing edge 34. The cooling system 14 may also include one or more bypass flow reducers 30 extending from the insert 18 toward the outer wall 24 to reduce flow of cooling fluids.

Figure 4:
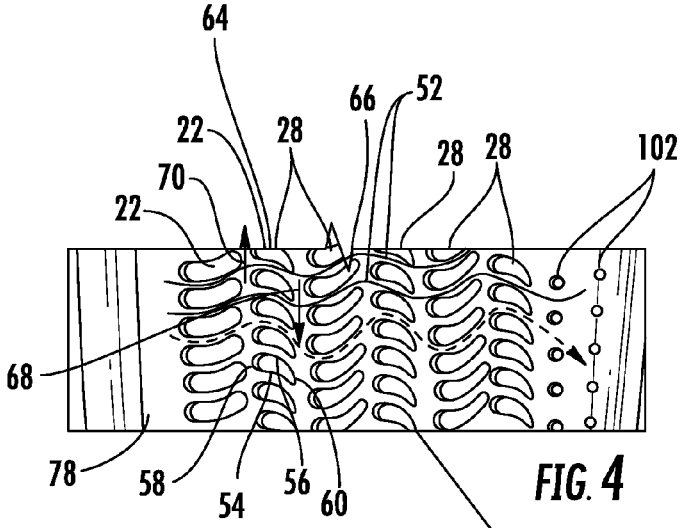
FIG. 4 is a detail view of the cooling fluids controllers and pin fins of the internal cooling system taken a detail line 4-4 in FIG. 3.
Figure 6:
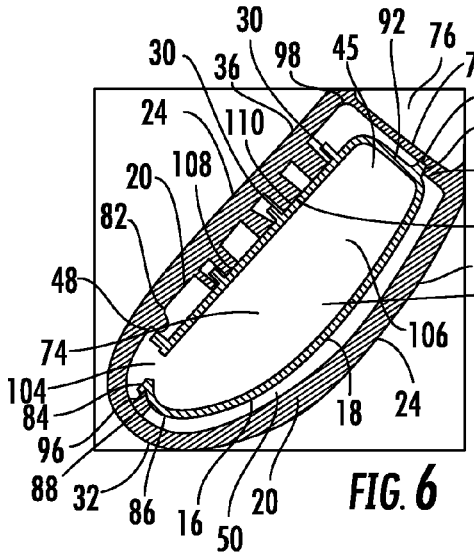
FIG. 6 is a perspective view of a cross-sectional view of the inner surface of the outer wall forming the pressure and suction sides together with the cooling fluids controllers, pin fins and impingement standoffs extending radially inward taken at section line 6-6 in FIG. 3.

As shown in FIG. 4, the cooling fluid flow controllers 22 may form a plurality of alternating zigzag channels 52 extending in a generally chordwise direction downstream toward the trailing edge 34. The zigzag channels 52 may be formed from one or more cooling fluid flow controllers 22 having a cross-sectional area formed by a pressure side 54 that is on an opposite side from a suction side 56, whereby the pressure and suction sides 54, 56 may be coupled together via a leading edge 58 and trailing edge 60 on an opposite end of the cooling fluid flow controller 22 from the leading edge 58. A first spanwise extending row 64 of cooling fluid flow controllers 22 may include a plurality of cooling fluid flow controllers 22 having cross-sectional areas formed by a pressure side 54 that is on an opposite side from a suction side 56, whereby the pressure and suction sides 54, 56 are coupled together via a leading edge 58 and trailing edge 60 on an opposite end of the cooling fluid flow controller 22 from the leading edge 58. A pressure side 54 of one cooling fluid flow controller 22 may be adjacent to a suction side 56 of an adjacent cooling fluid flow controller 22. In at least one embodiment, each of the cooling fluid flow controllers 22 within the first spanwise extending row 64 of cooling fluid flow controllers 22 may be positioned similarly, such that a pressure side 54 of one cooling fluid flow controller 22 is adjacent to a suction side 56 of an adjacent cooling fluid flow controller 22, except for a cooling fluid flow controller 22 at an end of the first spanwise extending row 64 where there is no adjacent cooling fluid flow controller 22.

The internal cooling system 14 may also include a second spanwise extending row 66 of cooling fluid flow controllers 22 positioned downstream from the first spanwise extending row 64 of cooling fluid flow controllers 22. The second spanwise extending row 66 of cooling fluid flow controllers 22 may have one or more cooling fluid flow controllers 22 with a pressure side 54 on an opposite side of the cooling fluid flow controller 22 than in the first spanwise extending row of cooling fluid flow controllers 22, thereby causing cooling fluid flowing through the second spanwise extending row 66 of cooling fluid flow controllers 22 to be directed downstream with a spanwise vector 68 that is opposite to a spanwise vector 70 imparted on the cooling fluid by the first spanwise extending row 64 of cooling fluid flow controllers 22.

Figure 3:
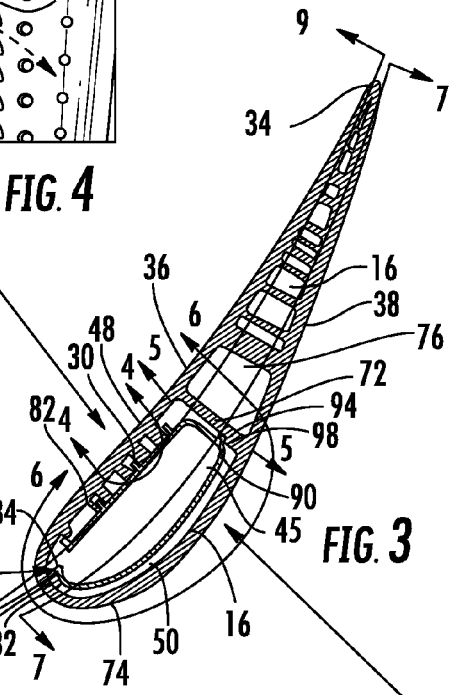
FIG. 3 is a cross-section view of the turbine vane taken at section line 3-3 in FIG. 2.
Figure 5:
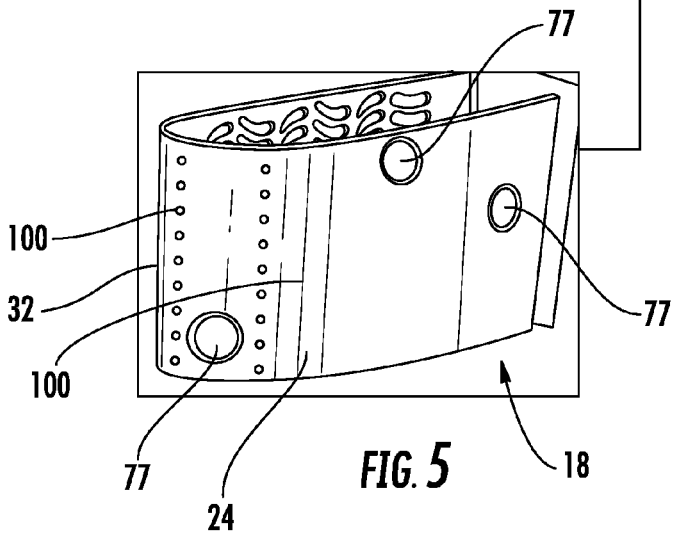
FIG. 5 is a detail view of the insert of the internal cooling system taken at detail line 5-5 in FIG. 3.
Figure 7:
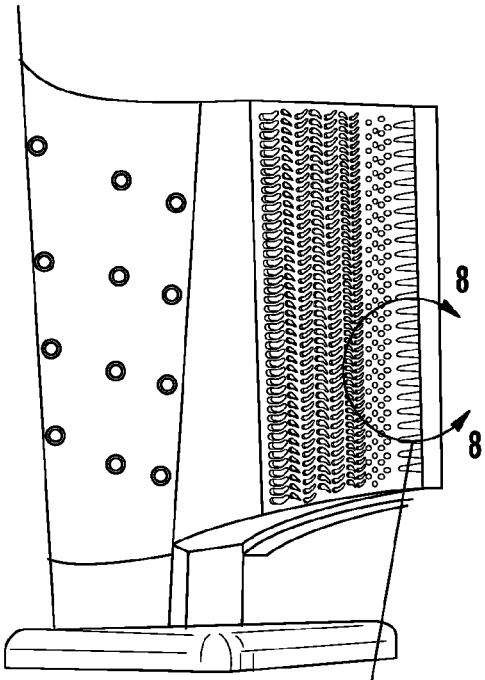
FIG. 7 is a cross-section view of the casting core forming the nearwall cooling channel at the suction side of the internal cooling system taken at section line 7-7 in FIG. 3.
Figure 9:
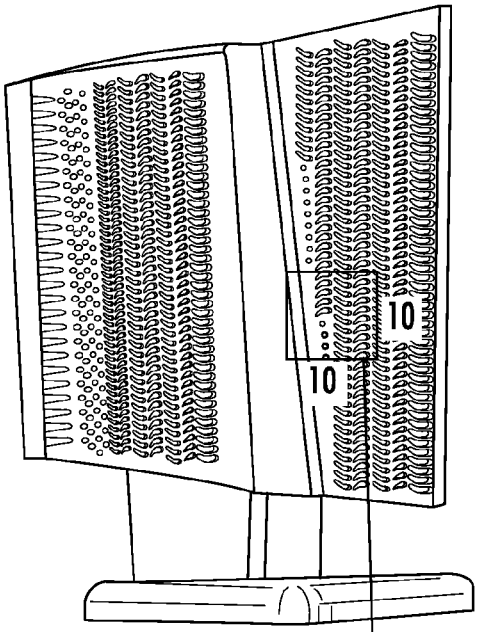
FIG. 9 is a cross-section view of the casting core forming the nearwall cooling channel at the pressure side of the internal cooling system taken at section line 9-9 in FIG. 3.
Figure 8:
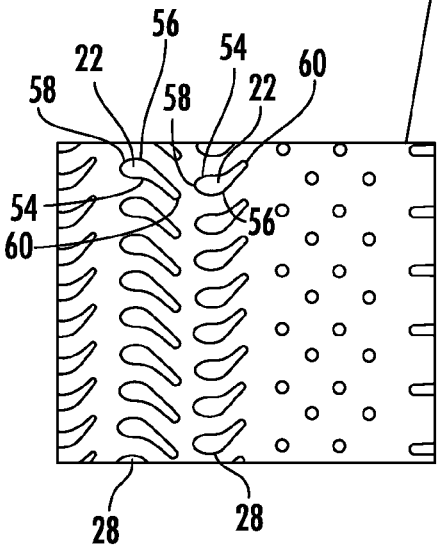
FIG. 8 is a detail view of the cooling fluids controllers and pin fins of the internal cooling system in the trailing edge cooling cavity taken a detail line 8-8 in FIG. 7.
Figure 10:
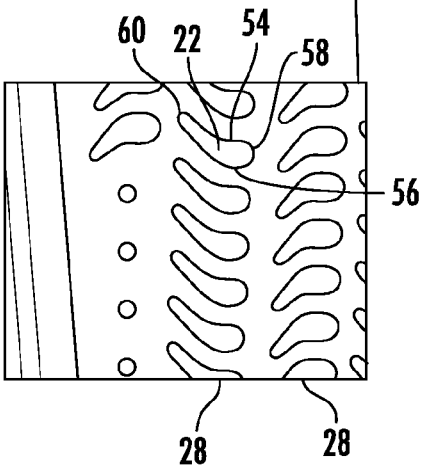
FIG. 10 is a detail view of the cooling fluids controllers and pin fins of the internal cooling system in the leading edge cooling cavity taken a detail line 10-10 in FIG. 9.
Figure 11:
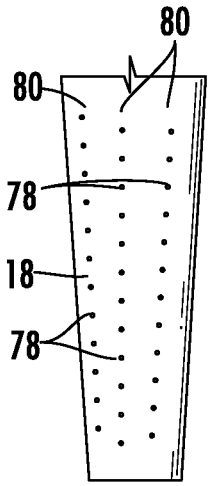
FIG. 11 is a suction side side view of the insert.
Figure 12:
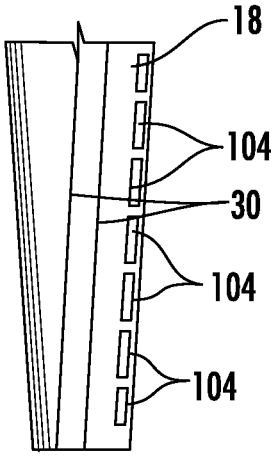
FIG. 12 is a pressure side view of the insert.
Figure 13:
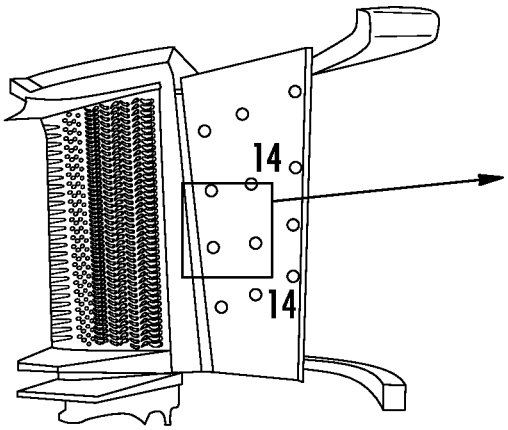
FIG. 13 is a cross-sectional view of an inner surface of the suction side taken at section line 13-13 in FIG. 1.
Figure 14:
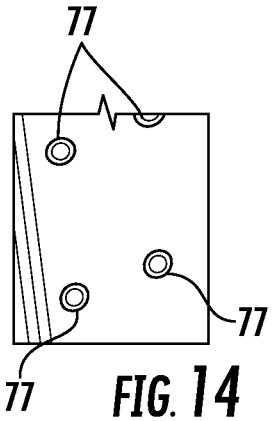
FIG. 14 is a detail view of the inner surface of the suction side taken at detail 14-14 in FIG. 13.
Figure 15:
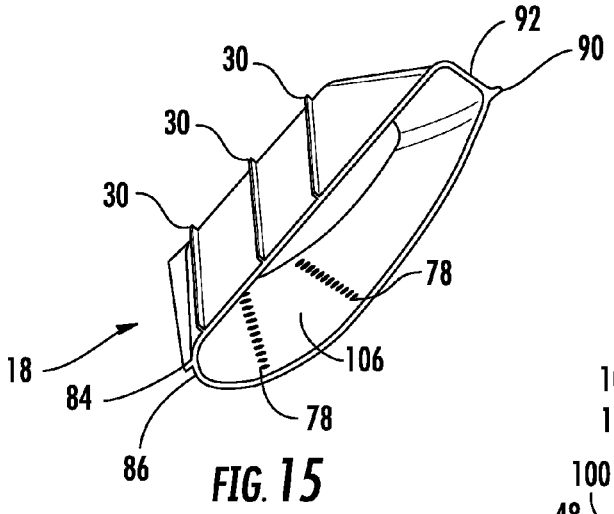
FIG. 15 is a perspective view of the insert.
Figure 17:
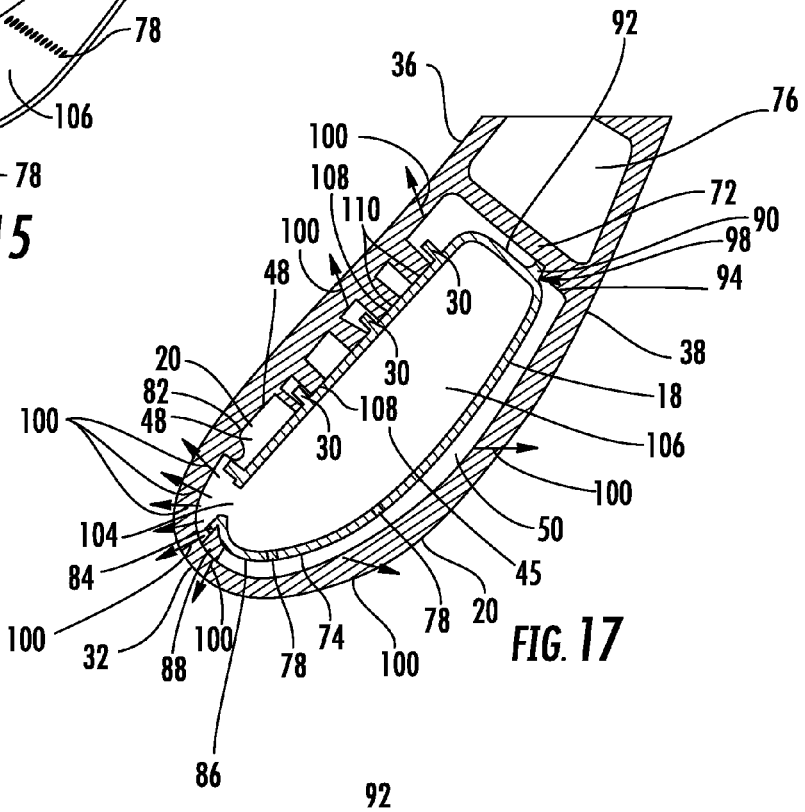
FIG. 17 is a detail, end view of the insert of the internal cooling system, with the insert showing the exhaust film cooling holes, taken at detail line 5-5 in FIG. 3.
Figure 16:
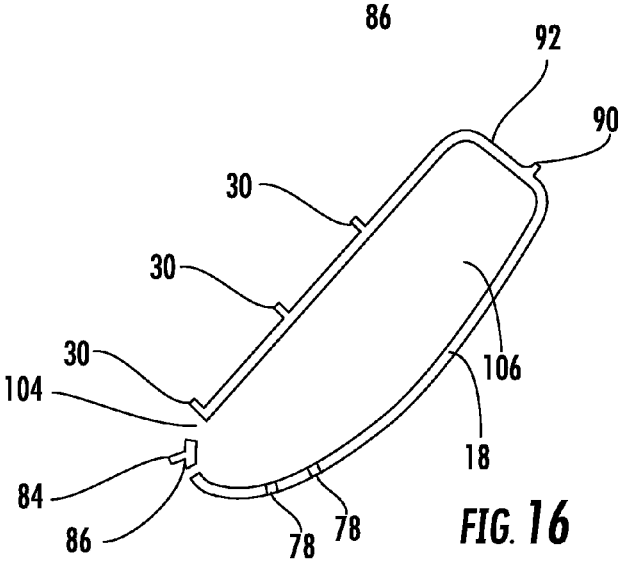
FIG. 16 is an end view of the insert.

In at least one embodiment, as shown in FIGS. 3, 5 and 17, the midchord cooling cavity 45 may include one or more ribs 72 separating the midchord cooling cavity 45 into a leading edge cooling cavity 74 and a trailing edge cooling cavity 76. One or more impingement standoffs 77 may extend from the outer wall 24 forming the suction side 38 radially inward toward the insert 18. A plurality of cooling fluid flow controllers 22 may extend from the outer wall 22 forming the pressure side 36 of the generally elongated hollow airfoil 26. The insert 18 may include one or more impingement holes 78 directed toward the suction side 38 of the generally elongated hollow airfoil 26. In another embodiment, the insert 18 may include a plurality of impingement holes 78 directed toward the suction side 38 of the generally elongated hollow airfoil 26. The impingement holes 78 may form a plurality of spanwise extending rows 80, as shown in FIG. 11.

In at least one embodiment, as shown in FIGS. 3, 5, 12, 15 and 16, the internal cooling system 14 may include a plurality of bypass flow reducers 30. One or more of the plurality of bypass flow reducers 30 may be positioned between adjacent spanwise extending rows 28 of cooling fluid flow controllers 22. The bypass flow reducer 30 may extend less than half a distance from the insert 18 to an inner surface 82 of the outer wall 24 forming the pressure side 36. In other embodiments, the bypass flow reducer 30 may extend more than half a distance from the insert 18 to the inner surface 82 of the outer wall 24 forming the pressure side 36. An insert 18 may have bypass flow reducers 30 with all the same height and lengths or varying heights and lengths.

The internal cooling system 14 may include a forward support rib 84, as shown in FIGS. 3, 5, 15 and 17, extending from an upstream end 86 of the insert 18 into contact with an upstream insert support 88 and an aft support rib 90 extending from a downstream end 92 of the insert 18 into contact with a downstream insert support 94. The forward support rib 84 extending from the upstream end 86 of the insert 18 may contact with a pressure side 96 of the upstream insert support 88, and the aft support rib 90 extending from the downstream end 92 of the insert 18 may contact a pressure side 98 of the downstream insert support 94. During operation, high pressure in the nearwall cooling channel 20 near the pressure side 36 forces the insert 18 toward the suction side 38, thereby seating the forward support rib 84 against the upstream insert support 88, and the aft support rib 90 against the downstream insert support 94.

The internal cooling system 14 may include one or more film cooling holes 100, as shown in FIGS. 4 and 17, extending through the outer wall 24 to exhaust cooling fluids from the nearwall cooling channel 20. The film cooling holes 100 may be positioned at the leading edge 32 to form a showerhead and may extend through the pressure and suction sides 36, 38. The film cooling holes 100 may have any appropriate length and cross-sectional shape. The film cooling holes in the pressure side 36, nearest to the rib 72 separating the leading edge cooling cavity 74 from the trailing edge cavity 76, may be formed from multiple spanwise extending rows, such as, but not limited to, two rows, and may be positioned at an acute angel relative to the pressure side 36, such as, but not limited to, about 30 degrees offset from orthogonal. The film cooling holes 100 may also be positioned at areas of highest pressure at the leading edge 32.

The internal cooling system 14 may include one or more rows of pin fins 102 extending from the outer wall 24 at the insert 18 downstream from the cooling fluid flow controllers 22. The pin fins 102 may have a generally circular cross-sectional area or other appropriate shape. The pin fins 102 extending from the outer wall 24 at the insert 18 downstream from the cooling fluid flow controllers 22 may be positioned in one or more spanwise extending rows 28 of pin fins 108. In at least one embodiment, the pin fins 102 may have a minimum distance between each other or between an adjacent structure other than the outer wall 24 of about 1.5 millimeters. The insert 18 may include one or more cooling fluid exhaust outlets 104 at the leading edge 32 for supplying cooling fluids to a nearwall cooling chamber 20 formed between the outer wall 24 forming the pressure side 36 and the insert 18. One or more bypass flow reducers 30 may extend from the insert 18 immediately downstream from the cooling fluid exhaust outlet 104 at the leading edge 32 for supplying cooling fluids to a nearwall cooling chamber 20 formed between the outer wall 24 forming the pressure side 36 and the insert 18.

The trailing edge cooling cavity 76 may include a plurality of cooling fluid flow controllers 22. In at least one embodiment, the plurality of cooling fluid flow controllers 22 may be positioned in one or more generally spanwise extending rows. The spanwise extending rows may be generally parallel to each other and may be parallel to the rib 72 separating the midchord cooling cavity 45 into the leading edge cooling cavity 74 and the trailing edge cooling cavity 76. The cooling fluid flow controllers 22 in the trailing edge cooling cavity 76 may extend from the outer wall 24 forming the pressure side 36 to the outer wall 24 forming the suction side 38. One or more rows of pin fins 102 may be positioned between the spanwise extending rows of cooling fluid flow controllers 22 and the trailing edge 34. Pin fins 102 within adjacent rows of pin fins 102 may be offset from each other in the spanwise direction.

During use, cooling fluids may be supplied from a compressor or other such source to the inner chamber 106 of the insert 18 of the internal cooling system 14. Cooling fluids may fill the insert 18 and generally flow spanwise throughout the insert 18. Cooling fluids are passed through the cooling fluid exhaust outlet 104 into the nearwall cooling channel 20 on the pressure side 36 and through the impingement holes 78 into the nearwall cooling channel 20 near the suction side 38. The cooling fluids in the nearwall cooling channel 20 on the pressure side 36 are prevented from flowing into the nearwall cooling channel 20 on the suction side 38 via the inset 18 and the forward support rib 84 and the aft support rib 90. The cooling fluids flowing from the impingement holes 78 into the nearwall cooling channel 20 near the suction side 38 impinge upon the inner surface of the outer wall 24 forming the suction side 38.

The cooling fluids in the nearwall cooling channel 20 on the pressure side 36 are directed toward an inner surface of the outer wall 24 forming the pressure side 36 by a first bypass flow reducer 30 where the cooling fluids flow through a first row of cooling fluid flow controllers 22 rather than flowing in between the small gap between a proximal end 108 of the cooling fluid flow controllers 22 and the insert 18. The bypass flow reducers 30 direct the cooling fluids towards the outer wall 24 forming the pressure side 36, thereby substantially reducing the flow of cooling fluids between the gap 110 created between the proximal end 108 of the cooling fluid flow controllers 22 and the insert 18. The gap may be about 0.2 millimeters in size due to assembly. Tighter tolerances on either side would aide flow and HIT characteristics, while increased clearances would negatively affect flow and H/T. In addition, the bypass flow reducers 30 direct the cooling fluids towards the outer wall 24 forming the pressure side 36, which directs the cooling fluids towards the outer wall 24, which is most need of cooling due to its direct exposure to the combustor exhaust gases. The cooling fluids flow through successive rows of cooling fluid flow controllers 22 zigzagging back and forth and increasing in temperature moving toward the trailing edge 34 as the cooling fluids pick up heat from the outer wall 24 and the cooling fluid flow controllers 22. The cooling fluids may also flow past one or more rows of pin fins 102 and may be exhausted from the film cooling holes 100. The cooling fluids may also form film cooling on an outer surface of the outer wall 24 via the film cooling holes 100 at the leading edge 32 that are configured to form a showerhead and the other film cooling holes in the outer walls 24 forming the pressure and suction sides 36, 38.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine airfoil for a gas turbine engine comprising:

a generally elongated hollow airfoil formed from an outer wall, and having a leading edge, a trailing edge, a pressure side, a suction side, and inner endwall at a first end and an outer endwall at a second end that is generally on an opposite side of the generally elongated hollow airfoil from the first end and a cooling system positioned within interior aspects of the generally elongated hollow airfoil;

the cooling system includes at least one midchord cooling cavity in which an insert is positioned that forms a pressure side nearwall cooling channel and a suction side nearwall cooling channel;

wherein a plurality of cooling fluid flow controllers extend from the outer wall forming the generally elongated hollow airfoil toward the insert, where the cooling fluid flow controllers form a plurality of alternating zigzag channels extending downstream toward the trailing edge; and wherein at least one bypass flow reducer extends from the insert toward the outer wall to reduce flow of cooling fluids.

2. The turbine airfoil of claim 1, wherein at least one of the cooling fluid flow controllers has a cross-sectional area formed by a pressure side that is on an opposite side from a suction side, whereby the pressure and suction sides are coupled together via a leading edge and trailing edge on an opposite end of the at least one cooling fluid flow controller from the leading edge.

3. The turbine airfoil of claim 2, wherein a first spanwise extending row of cooling fluid flow controllers includes a plurality of cooling fluid flow controllers having a cross-sectional areas formed by a pressure side that is on an opposite side from a suction side, whereby the pressure and suction sides are coupled together via a leading edge and trailing edge on an opposite end of the at least one cooling fluid flow controller from the leading edge and wherein a pressure side of one cooling fluid flow controller is adjacent to a suction side of an adjacent cooling fluid flow controllers.

4. The turbine airfoil of claim 3, wherein each of the cooling fluid flow controllers within the first spanwise extending row of cooling fluid flow controllers is positioned similarly, such that a pressure side of one cooling fluid flow controllers is adjacent to a suction side of an adjacent cooling fluid flow controllers, except for a cooling fluid flow controllers at an end of the first spanwise extending row.

5. The turbine airfoil of claim 3, wherein in that a second spanwise extending row of cooling fluid flow controllers positioned downstream from the first spanwise extending row of cooling fluid flow controllers.

6. The turbine airfoil of claim 5, wherein the second spanwise extending row of cooling fluid flow controllers has at least one cooling fluid flow controller with a pressure side on an opposite side of the cooling fluid flow controller than in the first spanwise extending row of cooling fluid flow controllers, thereby causing cooling fluid flowing through the second spanwise extending row of cooling fluid flow controllers to be directed downstream with a spanwise vector that is opposite to a spanwise vector imparted on the cooling fluid by the first spanwise extending row of cooling fluid flow controllers.

7. The turbine airfoil of claim 5, wherein the at least one midchord cooling cavity includes at least one rib separating the midchord cooling cavity into a leading edge cooling cavity and a trailing edge cooling cavity.

8. The turbine airfoil of claim 5, wherein in that at least one impingement standoff extending from the outer wall forming the suction side radially inward toward the insert.

9. The turbine airfoil of claim 2, wherein the plurality of cooling fluid flow controllers extend from the outer wall forming the pressure side of the generally elongated hollow airfoil.

10. The turbine airfoil of claim 9, wherein the insert includes a plurality of impingement holes directed toward the suction side of the generally elongated hollow airfoil.

11. The turbine airfoil of claim 1, wherein the least one bypass flow reducer comprises a plurality of bypass flow reducers.

12. The turbine airfoil of claim 11, wherein at least one of the plurality of bypass flow reducers is positioned between adjacent spanwise extending rows of cooling fluid flow controllers.

13. The turbine airfoil of claim 1, wherein in that a forward support rib extending from an upstream end of the insert into contact with an upstream insert support and an aft support rib extending from a downstream end of the insert into contact with a downstream insert support.

14. The turbine airfoil of claim 13, wherein the forward support rib extending from the upstream end of the insert contacts with a pressure side of the upstream insert support, and the aft support rib extending from the downstream end of the insert contacts a pressure side of the downstream insert support.

* * * * *